US010954454B2

(12) United States Patent
Sun et al.

(10) Patent No.: US 10,954,454 B2
(45) Date of Patent: Mar. 23, 2021

(54) NON-SOLVENT CRUDE OIL HEAVY OIL STREAM DE-ASPHALTING PROCESS

(71) Applicant: Saudi Arabian Oil Company, Dhahran (SA)

(72) Inventors: Miao Sun, Dhahran (SA); Zhonglin Zhang, Dhahran (SA); Sohel K. Shaikh, Dhahran (SA)

(73) Assignee: SAUDI ARABIAN OIL COMPANY

( * ) Notice: Subject to any disclaimer, the term of this patent is extended or adjusted under 35 U.S.C. 154(b) by 0 days.

(21) Appl. No.: 16/687,259

(22) Filed: Nov. 18, 2019

(65) Prior Publication Data

US 2020/0102507 A1 Apr. 2, 2020

Related U.S. Application Data

(63) Continuation-in-part of application No. 16/388,154, filed on Apr. 18, 2019, now Pat. No. 10,800,979, which is a continuation of application No. 15/682,079, filed on Aug. 21, 2017, now Pat. No. 10,308,880.

(51) Int. Cl.

| | |
|---|---|
| ***C10G 29/06*** | (2006.01) |
| ***C10G 17/02*** | (2006.01) |
| ***C10G 17/10*** | (2006.01) |
| ***C10G 75/00*** | (2006.01) |
| *C10G 31/10* | (2006.01) |
| *C10G 31/09* | (2006.01) |

(52) U.S. Cl.

CPC ..... *C10G 17/02* (2013.01); *C10G 17/10* (2013.01); *C10G 75/00* (2013.01); *C10G 31/09* (2013.01); *C10G 31/10* (2013.01); *C10G 2300/206* (2013.01); *C10G 2300/208* (2013.01)

(58) Field of Classification Search

CPC ..... C10G 29/06; C10G 2300/206

See application file for complete search history.

(56) References Cited

U.S. PATENT DOCUMENTS

| | | | | |
|---|---|---|---|---|
| 2,101,308 | A | 2/1932 | Bray et al. | |
| 2,337,448 | A | 1/1940 | Carr | |
| 2,367,671 | A | 11/1941 | Dickinson et al. | |
| 2,850,431 | A | 12/1955 | Smith | |
| 2,940,920 | A | 6/1960 | Garwin | |
| 3,159,571 | A | 12/1964 | Reman et al. | |
| 3,180,820 | A * | 4/1965 | Gleim | C10G 65/04 208/211 |
| 3,240,718 | A | 3/1966 | Gatsis | |
| 3,249,530 | A | 5/1966 | Gatsis | |
| 3,249,556 | A | 5/1966 | Gatsis | |
| 3,252,894 | A | 5/1966 | Gatsis | |
| 3,293,172 | A | 12/1966 | Gleim | |
| 3,331,769 | A | 7/1967 | Gatsis | |
| 3,364,138 | A | 1/1968 | Van Lookeren Campagne et al. | |
| 3,420,771 | A | 1/1969 | O'Hara et al. | |
| 3,813,329 | A | 5/1974 | Gatsis | |
| 3,825,488 | A | 7/1974 | Gatsis | |
| 4,101,415 | A | 7/1978 | Crowley | |
| 4,290,880 | A | 9/1981 | Leonard | |
| 4,548,711 | A | 10/1985 | Coombs et al. | |
| 5,171,727 | A * | 12/1992 | Gatsis | B01J 27/19 208/108 |
| 5,288,681 | A | 2/1994 | Gatsis | |
| 5,474,977 | A | 12/1995 | Gatsis | |
| 9,464,239 | B2 | 10/2016 | Nares Ochoa et al. | |
| 2013/0264247 | A1 | 10/2013 | Cardenas et al. | |
| 2015/0321975 | A1 | 11/2015 | Choi et al. | |
| 2017/0107433 | A1 | 4/2017 | Choi et al. | |

FOREIGN PATENT DOCUMENTS

KR 101472498 A 12/2017

OTHER PUBLICATIONS

H.-J. Eom et al., Hydrocracking of Extra-Heavy Oil Using CS-Exchanged Phosphotungstic Acid (CsxH3-xPW12O40, x = 1-3) Catalysts, 126 FUEL 263-270 (2014).*

Eom et al., "Hydrocracking of extra-heavy oil using Cs-exchanged phosphotungstic acid (CsxH3-xPW12O40, x=1-3) catalysts", 126 Fuel, 263-270 (2014).

The International Search Report and Written Opinion for related PCT application PCT/US2018/047240 dated Oct. 23, 2018.

Dec. 31, 1986Pelet, R.; Behar, F.; Monin, J.C., Resins and Asphaltenes in the Generation and Migration of Petroleum. Organic Geochemistry, Dec. 1986, vol. 10, Issues 1-3, pp. 481-498.

Dec. 31, 1991Payzant, J.D.; Lown, E.M.; Strausz, O.P., Structural Units of Athabasca Asphaltene: The Aromatics With a Linear Carbon Framework. Energy Fuels 1991, vol. 5, pp. 445-453.

Dec. 31, 2009Liao, Z.W.; Zhao, J.; Creux, P.; Yang, C.P., Discussion on the Structure Features of Asphaltene Molecules. Energy & Fuels 2009, vol. 23, pp. 6272-6274, 2009.

Feb. 28, 2012Abdel-Raouf, M.E. (Ed.), Crude Oil Emulsions: Composition Stability and Characterization. Rijeka, Croatia: InTech (2012).

(Continued)

*Primary Examiner* — Randy Boyer

(74) *Attorney, Agent, or Firm* — Bracewell LLP; Constance R. Rhebergen

(57) ABSTRACT

A process for removing asphaltenes from an oil feed, the process comprising the steps of introducing the oil feed to a de-asphalting column, where the oil feed comprises a carbonaceous material and asphaltenes, where the de-asphalting column comprises a heteropolyacid, operating the de-asphalting column at a reaction temperature and a reaction pressure for a residence time such that the heteropolyacid is operable to catalyze an acid catalyzed polymerization reaction of the asphaltenes to produce polymerized asphaltenes, the polymerized asphaltenes precipitate from the carbonaceous material in the oil feed, and withdrawing a de-asphalted oil from the de-asphalting column, where the de-asphalted oil is in the absence of the heteropolyacids, where the de-asphalted oil has a lower concentration of sulfur, a lower concentration of nitrogen, and a lower concentration of metals as compared to the oil feed, where the process for removing asphaltenes is in the absence of added hydrogen gas.

15 Claims, 8 Drawing Sheets

(56) References Cited

OTHER PUBLICATIONS

Jun. 27, 2011Karimi, A.; Qian, K.; Olmstead, W. N.; Freund, H.; Yung, C.; Gray, M.R., Quantitative Evidence for Bridged Structures in Asphaltenese by Thin Film Pyrolysis. Energy & Fuelds, 2011, vol. 25 (8), pp. 3581-3589.
Mar. 31, 2012Ashtari, M.; Ashrafizadeh, S.N; Bayat, M.; Asphaltene Removal From Crude Oil by Means of Ceramic Membrances. Journal of Petroleum Science and Engineering, Feb.-Mar. 2012; vols. 82-83, pp. 44-49.

* cited by examiner

NON-SOLVENT CRUDE OIL HEAVY OIL STREAM DE-ASPHALTING PROCESS

CROSS-REFERENCE TO RELATED APPLICATIONS

This patent application is a continuation-in-part of U.S. Non-Provisional application Ser. No. 16/388,154 filed on Apr. 18, 2019, which is a continuation of U.S. Non-Provisional patent application Ser. No. 15/682,079 filed on Aug. 21, 2017. For purposes of United States patent practice, both non-provisional applications are incorporated by reference in their entirety.

TECHNICAL FIELD

Disclosed are methods for upgrading petroleum. Specifically, disclose are methods and systems for upgrading petroleum by removal of asphaltenes.

BACKGROUND

Asphaltenes are one of the four main constituents of crude oil, which also include saturates, aromatics, and resins. Asphaltenes are the heaviest and most polar compounds of crude oil. Due to the polarity of the asphaltenes, they tend to associate via complex interactions.

Asphaltenes impact virtually all aspects of the utilization of crude oils, and mostly have negative effects. For example, asphaltenes precipitation or deposition can occur in wellbores, pipelines, and surface facilities and is undesirable because it reduces well productivity and limits fluid flow. For refiners, asphaltenes cause concern because they can clog the refining system. Due to presence of sulfur, nitrogen and metals in the structures, asphaltenes can cause rapid catalyst deactivation during catalytic processing of crude oils. Therefore, asphaltenes are a cause of major economic, technical and safety problems during the production and processing of crude oils.

Given the operational problems caused by the presence of asphaltenes, separation of asphaltenes and other heavy species from crude oil is desirable. Solutions to address the operational problems of asphaltenes must address both problems of asphaltenes precipitation. And these solutions must improve the crude oil specifications including raising API gravity and decreasing crude oil viscosity. The API gravity and viscosity impact the price of crude oil.

One solution that addresses asphaltenes precipitation is the use of anti-scaling agents. Anti-scaling agents have been tested by researchers as a way to stabilize the asphaltenes suspensions in the crude oil, and by stabilizing the asphaltenes prevents precipitation during crude oil transportation and refining. However, asphaltenes decompose at high temperatures even with the use of anti-scaling agents, which can cause coke formation in heat exchanger and furnaces.

Another solution is hydrotreating the crude oil. Hydrotreating is a process that uses hydrogen to convert compounds in the crude oil. Hydrotreating requires high temperatures and high pressures which results in a process that is energy intensive. In addition, hydrotreating requires expensive catalyst. The use of hydrogen poses a risk of hydrogen explosion. Finally, tail gas from a hydrotreater cannot be directly released to the atmosphere, requiring some type of tail gas exhaust treatment.

Conventional asphaltene separation technology, generally referred to as solvent de-asphalting (SDA), involves the application of paraffinic solvents. SDA processes are based on liquid-liquid extraction using paraffinic solvents. SDA technology is considered one of the most efficient approaches to reduce asphaltenes and metal content of crude oil and heavy oil cuts to produce higher-value de-asphalted oil (DAO). SDA processes offer the advantages of low installation cost and flexibility in terms of the ability to control the quality of asphaltenes and DAO. However, the SDA process requires a considerable amount of expensive paraffinic solvents (the paraffinic solvent to crude oil ratio is typically from 2:1 to 10:1 by volume). The paraffinic solvent type directly decides the yield and quality of DAO; as the carbon number of the paraffinic solvent increases, the yield of recovered DAO will increase, but the quality of DAO will be reduced. Furthermore, the separation and recovery of paraffinic solvents from DAO are energy-intensive processes. Solvent recovery through a distillation process is not possible due to the wide range of boiling points of crude oil components, so a more complex solvent recovery technique, such as single-effect evaporation, double-effect evaporation, or triple-effect evaporation is needed. The large amount of waste paraffinic solvents is also another drawback of SDA.

SUMMARY

Disclosed are methods for upgrading petroleum. Specifically, disclosed are methods and systems for upgrading petroleum by removal of asphaltenes.

In a first aspect, a process for removing asphaltenes from an oil feed is provided. The process includes the steps of introducing the oil feed to a de-asphalting column, where the oil feed includes a carbonaceous material and asphaltenes, where the de-asphalting column includes a heteropolyacids, operating the de-asphalting column at a reaction temperature and a reaction pressure for a residence time such that the heteropolyacid is operable to catalyze an acid catalyzed polymerization reaction of the asphaltenes to produce polymerized asphaltenes, where the polymerized asphaltenes precipitate from the carbonaceous material in the oil feed, where the de-asphalting column is in the absence of water, and withdrawing a de-asphalted oil from the de-asphalting column, where the de-asphalted oil is in the absence of the heteropolyacids, where the de-asphalted oil has a lower concentration of sulfur, a lower concentration of nitrogen, and a lower concentration of metals as compared to the oil feed, where the process for removing asphaltenes is in the absence of added hydrogen gas.

In certain aspects, the process further includes the steps of stopping the oil feed, introducing a washing agent to a top of the de-asphalting column, where the washing agent flows through the de-asphalting column for a washing time, where the washing agent includes a solvent, the solvent operable to dissolve the polymerized asphaltenes in the de-asphalting column, removing a dirty solvent from a bottom of the de-asphalting column, where the dirty solvent includes dissolved polymerized asphaltenes, introducing the dirty solvent to an evaporator, where the evaporator is configured to separate the polymerized asphaltenes from the solvent, withdrawing the solvent from the evaporator as a cleaned solvent stream, and withdrawing the polymerized asphaltenes as a recovered asphaltenes. In certain aspects, the process further includes the steps of stopping the flow of the washing agent to the de-asphalting column, applying a vacuum to the de-asphalting column to remove residual solvent on the heteropolyacids, withdrawing the residual solvent from the de-asphalting column as a residual solvent stream, introducing the residual solvent stream to a condenser, condensing the residual solvent stream in the condenser to produce a condensed solvent stream, and introducing the condensed solvent stream to the evaporator. In certain aspects, the carbonaceous material can be selected from the group consisting of crude oil, heavy crude oil, light crude oil, vacuum residue streams, and atmospheric distillation streams. In certain aspects, the concentration of asphaltenes in the oil feed is between 1% by weight and 20% by weight. In certain aspects, the heteropolyacid is selected from the group consisting of Keggin-type heteropolyacids, cesium substituted heteropolyacids, and combinations of the same. In certain aspects, the Keggin-type heteropolyacid is selected from the group consisting of phosphortungstic heteropolyacid (H3PW12O40), phosphormolybdic heteropolyacid (H3PMo12O40), silicotungstic heteropolyacid (H4SiW12O40) silicomolybdic heteropolyacid (H4SiMo12O40), and combinations of the same. In certain aspects, the cesium substituted heteropolyacid is selected from the group consisting of CsxHyPMo12O40, in which 0<x<4 and y equals 3−x, CsxHyPW12O40, in which 0<x<4 and y equals 4−x, CsxHySiMo12O40, in which 0<x<4 and y equals 3−x, and CsxHySiW12O40, in which 0<x<4 and y equals 4−x. In certain aspects, the reaction temperature is between 60 deg C. and 100 deg C. In certain aspects, where the reaction pressure is between 0 bar and 100 bar. In certain aspects, the residence time is between 10 minutes and 30 minutes. In certain aspects, the evaporator includes a distillation column type heater. In certain aspects, the de-asphalted oil contains less than 1% by weight asphaltenes. In certain aspects, the process further includes the step of introducing the de-asphalted oil to an upgrading reactor to produce an upgraded product. In certain aspects, the solvent includes toluene.

In a second aspect, a system for removing asphaltenes from an oil feed is provided. The system includes a de-asphalting column, the de-asphalting column configured to operate at a reaction pressure, a reaction temperature, and for a residence time such that an acid catalyzed polymerization reaction of asphaltenes in the oil feed occurs to produce a polymerized asphaltenes, where the de-asphalting column is in the absence of water, where the de-asphalting column includes a heteropolyacid, and an evaporator fluidly connected to the de-asphalting column, the evaporator configured to separate the polymerized asphaltenes from a solvent to produce a cleaned solvent stream and a recovered asphaltenes, where the recovered asphaltenes includes the polymerized asphaltenes.

In certain aspects, the system further includes an upgrading reactor fluidly connected to the separator, the upgrading reactor configured to upgrade the de-asphalted oil.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

DETAILED DESCRIPTION

Figure 1:
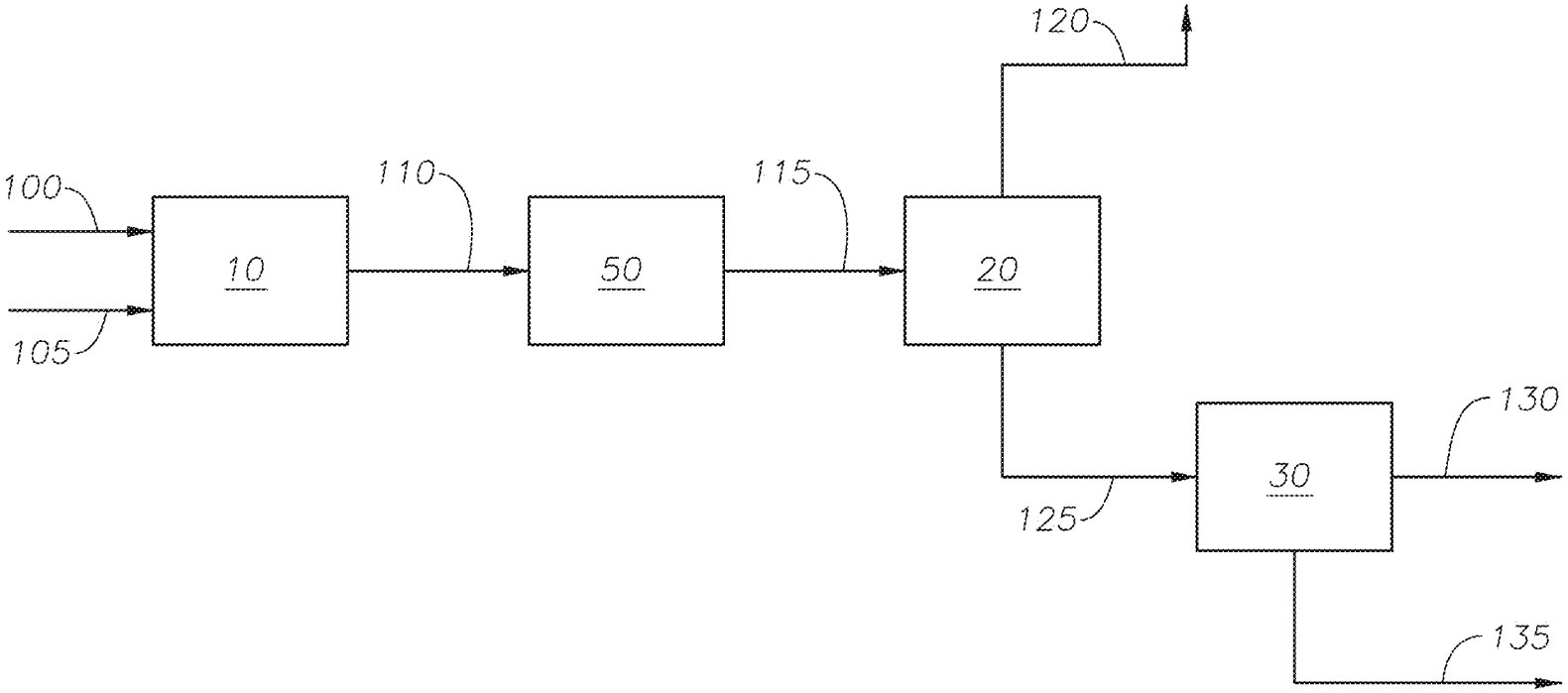
FIG. 1 provides a process diagram of an embodiment of the process.

While the scope will be described with several embodiments, it is understood that one of ordinary skill in the relevant art will appreciate that many examples, variations and alterations to the apparatus and methods described herein are within the scope and spirit. Accordingly, the embodiments described are set forth without any loss of generality, and without imposing limitations, on the embodiments. Those of skill in the art understand that the scope includes all possible combinations and uses of particular features described in the specification.

Described here are processes and systems for the removal of asphaltenes from a petroleum stream. Advantageously, the processes and systems described are in the absence of paraffinic solvents, which avoids the generation of solvent waste. Advantageously, the processes and systems described remove asphaltenes under mild conditions which reduces the production of coke. Advantageously, the de-asphalted oil produced can have low viscosity and reduces amounts of asphaltenes and metals. Advantageously, the systems and processes described can prolong catalyst life by treating the heteropolyacids in the de-asphalting column. Advantageously, the described systems and processes recycle solvents which reduces solvent waste compared to other de-asphalting processes. Advantageously, the use of de-asphalting column results in an effluent stream from the de-asphalting column that can be used without further processes to separate the de-asphalted oil.

As used throughout, "asphaltenes" refers to a mix of high molecular weight polycyclic aromatic hydrocarbons, which consist primarily of carbon, hydrogen, nitrogen, oxygen and sulfur with trace amounts of metals such as vanadium and nickel, and a hydrogen to carbon ratio of about 1.2 to 1. Operationally, asphaltenes refers to the n-heptane-insoluble, toluene soluble component of a carbonaceous material. Asphaltenes are the sticky, black, highly viscous residue of distillation processes. Asphaltenes contain highly polar species that tend to associate or aggregate, which has made complete molecular analysis of asphaltenes, for example by mass spectrometry, difficult.

As used throughout, "heteropoly compounds" or "heteropolyoxomatalates" or "polyoxometalates" refers to solid compounds that have discrete anionic units of metal oxides as metal-oxygen polyhedron units organized by at least one central atom being referred to as the heteroatom. Heteroatoms can include silicon in the oxidation state +4 ($Si^{4+}$), germanium in the oxidation state +4 ($Ge^{4+}$), phosphorous in the oxidation state +5 ($P^{5+}$), arsenic in the oxidation state +5 ($As^{5+}$), boron in the oxidation state +3 ($B^{3+}$). The primary metal-oxygen polyhedron units form a secondary structure by being associated with interstitial guest species, such as water, alcohols, ethers, amines, and cesium. Aggregations of these secondary structures form a tertiary structure that dictates the physical characteristics of the material, such as, for example, porosity, particle size, and surface area. Metal oxides and zeolites are not heteropoly compounds, as metal oxides and zeolites have metal oxygen lattices. Heteropoly compounds include heteropolyacids, their salts, and compounds derived from them that maintain essentially the heteropolyanion structure. Heteropoly compounds can be stable at temperatures up to 400 degrees Celsius (deg C.).

As used throughout, "heteropolyacids" are a type of heteropoly compound. Examples of heteropolyacids include Keggin-type heteropolyacids, cesium substituted heteropolyacids, and combinations of the same. Keggin-type heteropolyacids can include phosphortungstic heteropolyacid ($H_3PW_{12}O_{40}$), phosphomolybdic heteropolyacid ($H_3PMo_{12}O_{40}$), silicotungstic heteropolyacid ($H_4SiW_{12}O_{40}$) silicomolybdic heteropolyacid ($H_4SiMo_{12}O_{40}$), and combinations of the same. Cesium substituted heteropolyacids can include $Cs_xH_yPMo_{12}O_{40}$, $Cs_xH_yPW_{12}O_{40}$, $Cs_xH_ySiMo_{12}O_{40}$ and $Cs_xH_ySiW_{12}O_{40}$, in which $0<x<4$ and y equals 4−x when the heteroatom is tungsten (W) and y equals 3−x when the heteroatom is molybdenum (Mo) and combinations of the same. Keggin-type heteropolyacids can be water-soluble. Cesium substituted heteropolyacids can be water insoluble. The heteropolyacids used in the systems and processes are solids.

As used throughout, "paraffinic solvent" refers to n-paraffins having between three carbon atoms and seven carbon atoms inclusive. Paraffinic solvents can include n-propane, n-butane, n-pentane, n-hexane, n-heptane, and combinations thereof.

As used throughout, "de-asphalted oil" refers to a petroleum stream containing less than 1 percent (%) by weight asphaltenes, alternately less than 0.5% by weight asphaltenes, and alternately 0% by weight asphaltenes. De-asphalted oil contains a lower concentration of sulfur compounds, nitrogen compounds, and metals, including nickel and vanadium, as compared to the carbonaceous material in the feed stream to the reactor. The de-asphalted oil can have a viscosity, a density, a level of metals and asphaltenes similar to that of an extra light crude oil.

As used throughout, "gas environment" refers to a gas being introduced to the head space in the reactor and filling the open volume on top of the liquid level.

Referring to FIG. 1, oil feed 100 and heteropolyacid feed 105 can be introduced to reactor 10.

Oil feed 100 can be any carbonaceous material containing asphaltenes. Carbonaceous materials containing asphaltenes can include crude oil, heavy crude oil, light crude oil, vacuum residue streams, atmospheric distillation streams, pyrolysis oil from a steam cracking process, and combinations of the same. The concentration of asphaltenes in oil feed 100 can be between 1% by weight and 20% by weight, alternately between 1% by weight and 17% by weight, alternately less than 5% by weight, and alternately between 15% by weight and 20% by weight. In at least one embodiment, oil feed 100 is a light crude oil with a concentration of asphaltenes of less than 5% by weight. In at least one embodiment, oil feed 100 is a heavy crude oil with a concentration of asphaltenes between 15% by weight and 20% by weight. Precipitation of asphaltenes in light crude oils is often observed because even though the light crude oils have low concentrations of asphaltenes, the light crude oils contain high amounts of light alkanes in which asphaltenes have limited solubility.

Reactor 10 can be any reactor unit capable of facilitating a batch reaction. Examples of reactor 10 include tank units. In at least one embodiment, reactor 10 is a tank reactor with an agitation unit capable of facilitating a batch reaction. Reactor 10 can be under a gas environment. Examples of gases suitable for use in the gas environment include, air, oxygen, nitrogen, argon, and other inert gases. In at least one embodiment, reactor 10 can be under an air environment. Reactor 10 can operate at a reaction pressure, a reaction temperature, and for a reaction time. The reaction pressure can be at atmospheric pressure. The reaction temperature can be between room temperature and 100 deg C., alternately between 20 deg C. and 100 deg C., alternately between 25 deg C. and 100 deg C., alternately between 30 deg C. and 90 deg C., alternately between 40 deg C. and 80 deg C., alternately between 50 deg C. and 70 deg C., and alternately between 55 deg C. and 65 deg C. In at least one embodiment, the reaction temperature is between 55 deg C. and 65 deg C. The reaction time can be between 1 hour and 5 hours, alternately between 3 hours and 5 hours. The reaction temperature and the reaction time can be designed and adjusted based on the type of carbonaceous material in oil feed 100 and the type of heteropolyacid in heteropolyacid feed 105. Reactor 10 is in the absence of a paraffinic solvent. Reactor 10 is in the absence of water.

Figure 2:
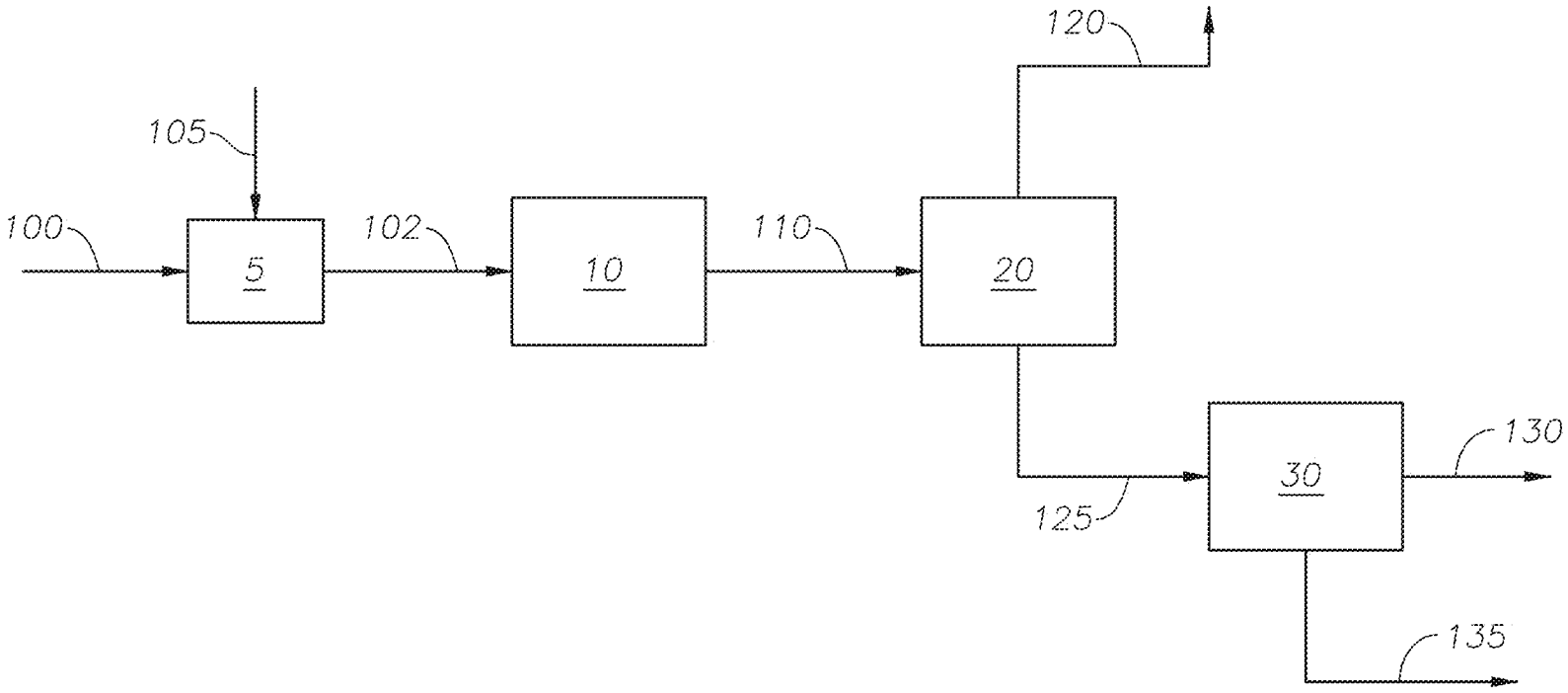
FIG. 2 provides a process diagram of an embodiment of the process.
Figure 3:
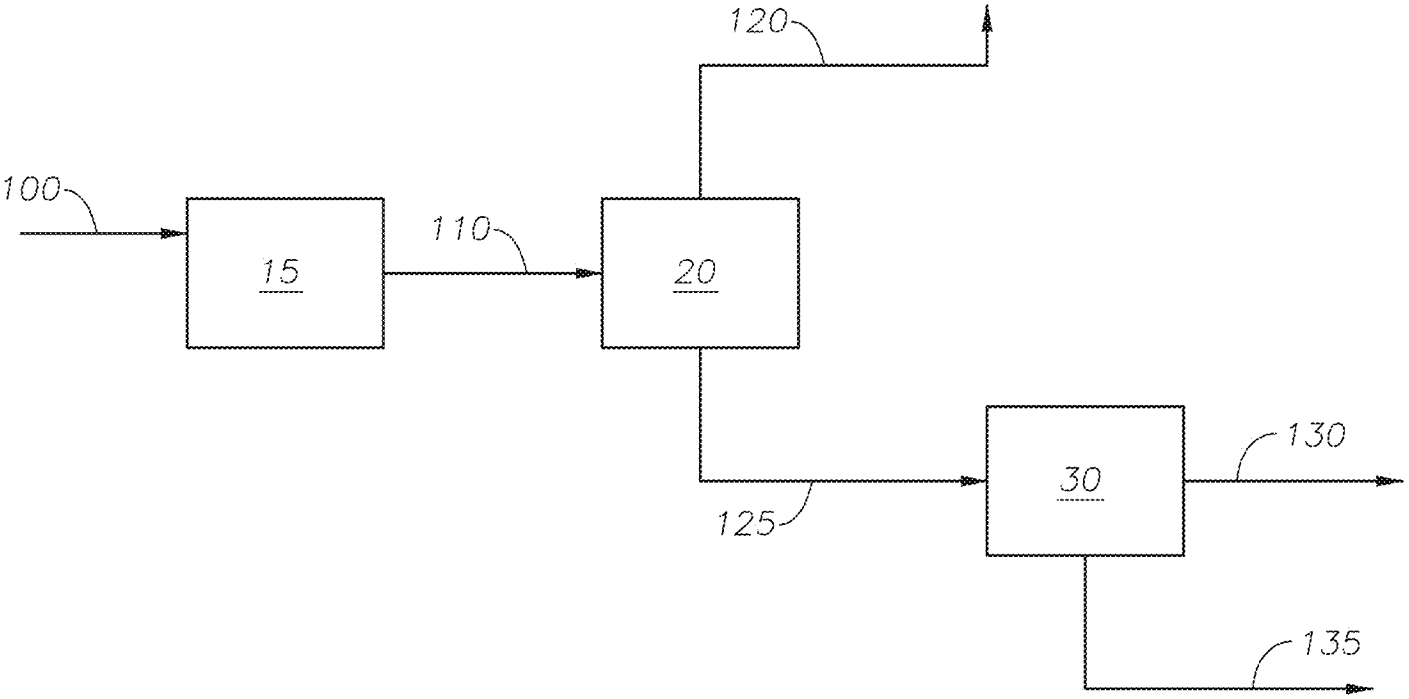
FIG. 3 provides a process diagram of an embodiment of the process.

Heteropolyacid feed 105 can include a heteropolyacid. Heteropolyacid feed 105 can include the dry solid heteropolyacid and be in the absence of a carrier liquid. Heteropolyacid feed 105 can include Keggin-type heteropolyacids, cesium substituted heteropolyacids, and combinations of the same. As shown in FIG. 1, heteropolyacid feed 105 can be introduced to reactor 10. In at least one embodiment, heteropolyacid feed 105 can be introduced to reactor 10 with use of a hopper. In at alternate embodiment, with reference to FIG. 2, oil feed 100 and heteropolyacid feed 105 can be introduced to mixer 5 upstream of reactor 10. Mixer 5 can be any unit capable of mixing a petroleum stream and a solids stream. Mixer 5 can produce mixed feed 102 which can be introduced to reactor 10. In an alternate embodiment, with reference to FIG. 3, the heteropolyacids can be added to charged reactor 15 prior to oil feed 100, such that prior to the beginning of the reaction time charged reactor 15 contains heteropolyacids. At the beginning of the reaction time, oil feed 100 is introduced to charged reactor 15. Charged reactor 15 can have the same reaction temperature, reaction pressure, and reaction time as described with reference to reactor 10. Charged reactor 15 is in the absence of paraffinic solvent. In at least one embodiment, at the end of the reaction time, the entire contents of charged reactor 15, including the heteropolyacids can be removed in mixed product 110. The ratio of oil feed 100 to heteropolyacid feed 105 can be 10 to 1 on a volume basis, and alternately 8.33 to 1 on a volume basis. At ratios outside of this range, the feed conversion and product distribution can impact the speed of reaction.

In reactor 10 and charged reactor 15, the heteropolyacids serve as a catalyst for an acid catalyzed polymerization reaction of the asphaltenes to produced polymerized asphaltenes.

Returning to FIG. 1, mixed product 110 can exit reactor 10 at the end of the reaction time. Mixed product 110 contains de-asphalted oil, polymerized asphaltenes, asphaltenes and used heteropolyacids. The polymerized asphaltenes can be suspended in mixed product 110. Mixed product 110 can be introduced to cooling unit 50.

Figure 4:
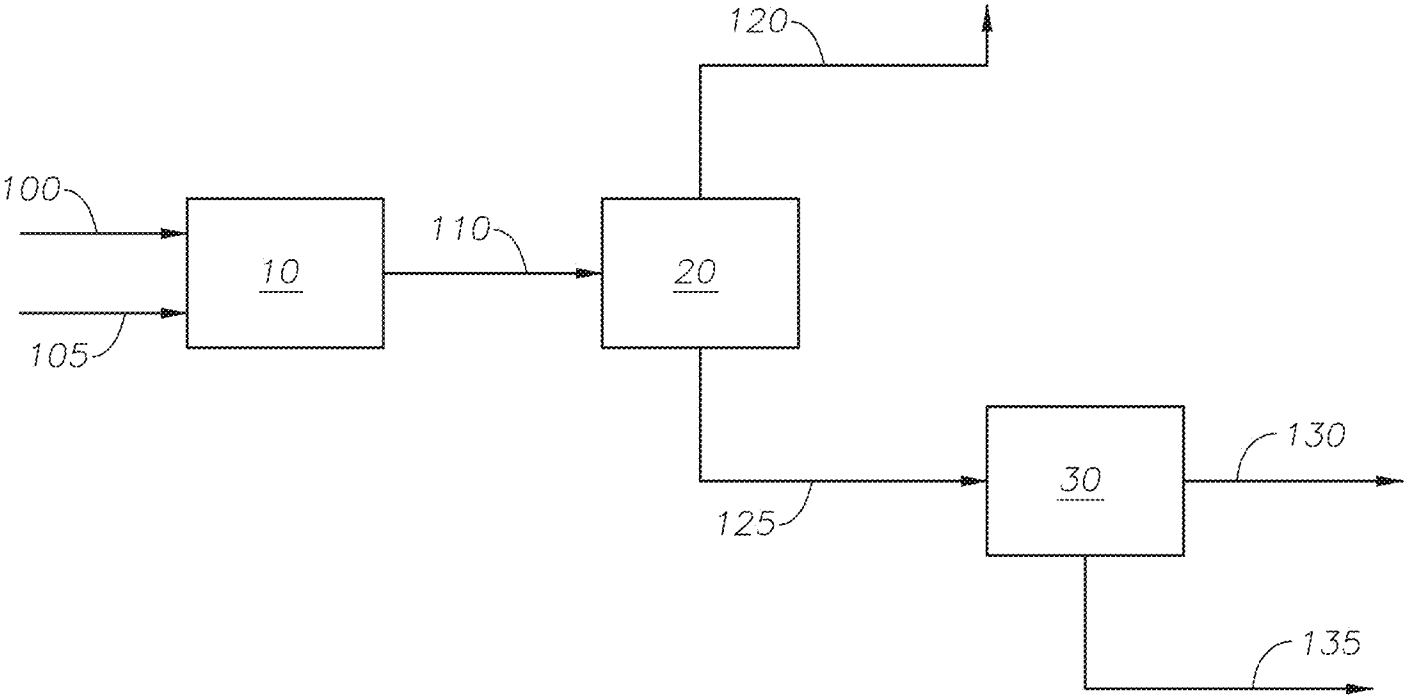
FIG. 4 provides a process diagram of an embodiment of the process.

Cooling unit 50 can be any type of heat exchanger capable of reducing the temperature of mixed product 110 to produce cooled product 115. Cooled product 115 can have a temperature between room temperature and 75 deg C., alternately between 20 deg C. and 75 deg C., alternately between 20 deg C. and 70 deg C., alternately between 20 deg C. and 60 deg C., alternately between 20 deg C. and 50 deg C., alternately between 20 deg C. and 40 deg C., alternately between 20 deg C. and 30 deg C., alternately between 20 deg C. and 25 deg C., and alternately between 25 deg C. and 30 deg C. In at least one embodiment, the temperature cooled product 115 is 25 deg C. In at least one embodiment, the system for the removal of asphaltenes from a petroleum stream is in the absence of a cooling unit as shown in FIG. 4, and mixed product 110 is introduced directly to product separator 20. Cooled product 115 can be introduced to product separator 20.

Figure 5:
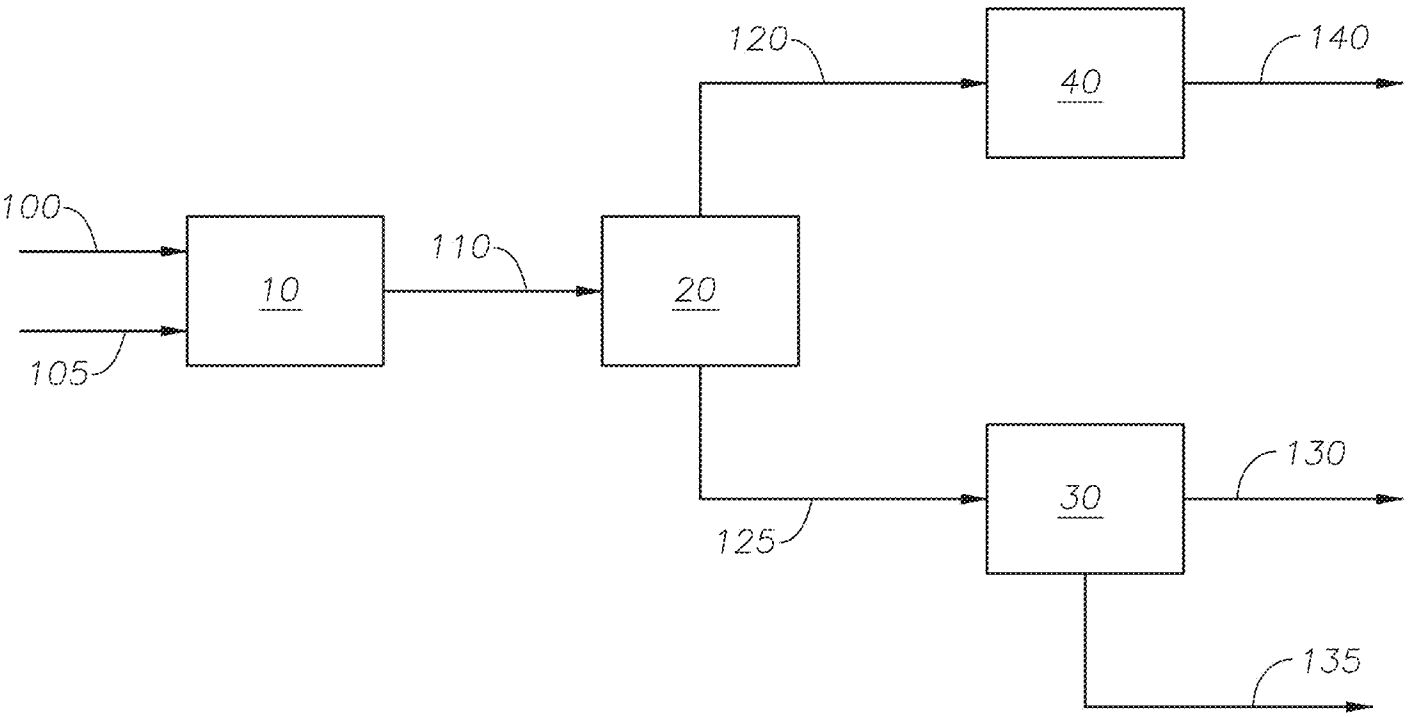
FIG. 5 provides a process diagram of an embodiment of the process.

Product separator 20 can be any type of separation unit capable of separating de-asphalted oil from cooled product 115 to produce de-asphalted oil 120 and waste stream 125. In at least one embodiment, product separator 20 is a centrifuge that separates de-asphalted oil to produce de-asphalted oil 120. In at least one embodiment, product separator 20 includes a membrane filtration separator. De-asphalted oil 120 contains de-asphalted oil with a lower concentration of sulfur, lower concentration of nitrogen, and lower concentration of metals as compared to the carbonaceous material in oil feed 100. De-asphalted oil 120 has a lower viscosity relative to oil feed 100. De-asphalted oil 120 can be further processed. In at least one embodiment, as shown with reference to FIG. 5, de-asphalted oil 120 can be introduced to upgrading reactor 40 to produce upgraded product 140. Upgrading reactor 40 can include a catalytic cracker. In at least one embodiment, upgrading reactor 40 is a catalytic cracker and upgraded product 140 includes light olefins and light aromatics. De-asphalted oil 120 can be sent to storage or combined with other oil streams.

Returning to FIG. 1, waste stream 125 can be introduced to asphaltene recovery unit 30. Waste stream 125 contains polymerized asphaltenes, asphaltenes, and used heteropolyacids. Asphaltene recovery unit 30 can be any type of batch unit capable of dissolving the polymerized asphaltenes and the asphaltenes in a solvent to create an asphaltene solution. The asphaltene solution contains the solvent and the dissolved polymerized asphaltenes and the asphaltenes. The used heteropolyacids do not dissolve in the solvent, so the used heteropolyacids can be separated from the asphaltene solution. In at least one embodiment, asphaltene recovery unit 30 can include a centrifuge or filtration to separate the used heteropolyacids from the asphaltene solution. In at least one embodiment, the solvent in asphaltene recovery unit 30 is toluene. The used toluene can then be evaporated leaving behind recovered asphaltenes. The recovered asphaltenes can have a jelly like consistency. The recovered asphaltenes can include polymerized asphaltenes, asphaltenes, and combinations of the same. Asphaltene recovery unit 30 can separate waste stream 125 to produce recovered heteropolyacids 130 and recovered asphaltenes 135. Recovered heteropolyacids 130 contains the used heteropolyacids. In at least one embodiment, recovered heteropolyacids 130 can be subjected to an additional wash with toluene to further purify the used heteropolyacids and the purified heteropolyacids can be recycled to reactor 10. Advantageously, the used heteropolyacids sustain the same structure as the heteropolyacids in heteropolyacid feed 105. Recovered asphaltenes 135 contains the recovered asphaltenes. Recovered asphaltenes contains both polymerized asphaltenes and asphaltenes. In at least one embodiment, the recovered asphaltenes can contain an amount of heteropolyacids less than 10% by weight, alternately less than 5% by weight, alternately less than 1% by weight, and alternately 0% by weight. In at least one embodiment, recovered asphaltenes 135 is in the absence of heteropolyacids. Recovered asphaltenes 135 can be collected and further processed to make asphaltene-based products, such as fibers.

Figure 8:
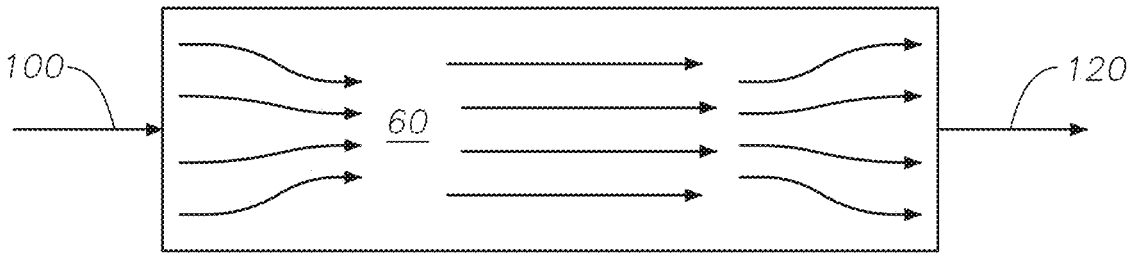
FIG. 8 provides a process diagram of an embodiment of the process.
Figure 9:
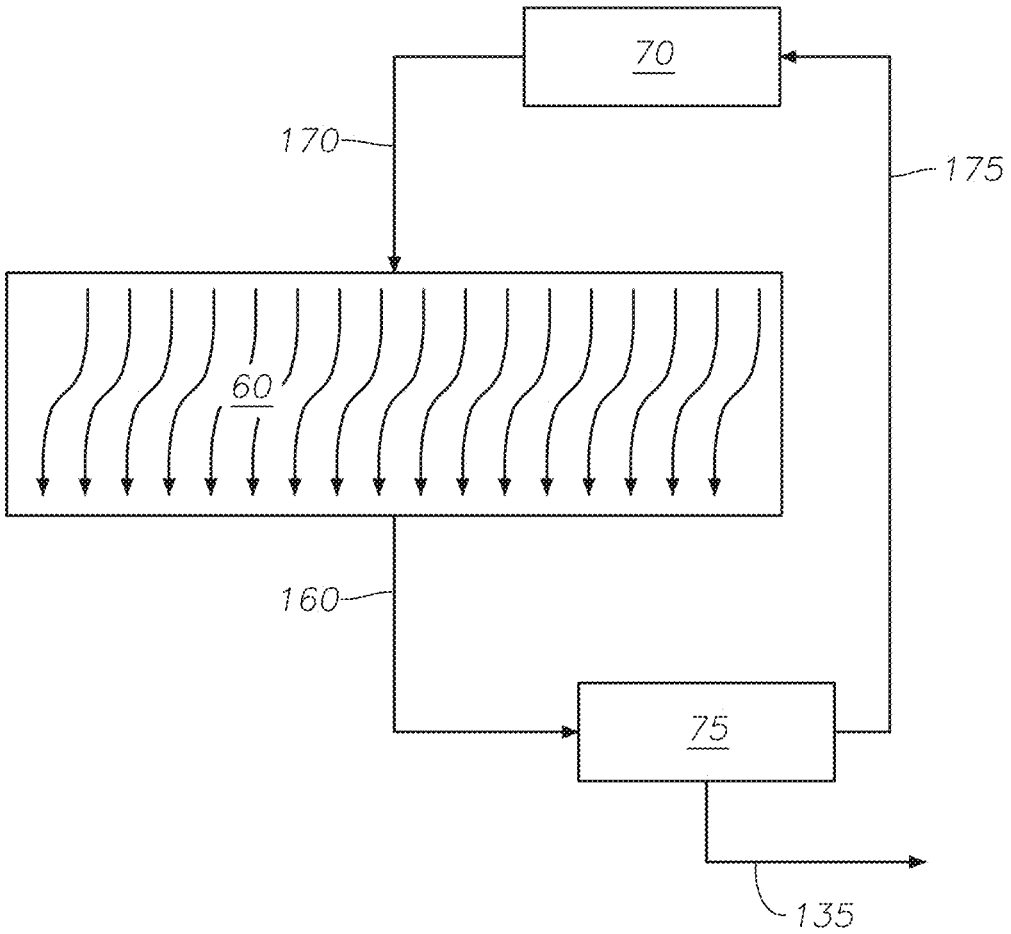
FIG. 9 provides a process diagram of an embodiment of the process.
Figure 10:
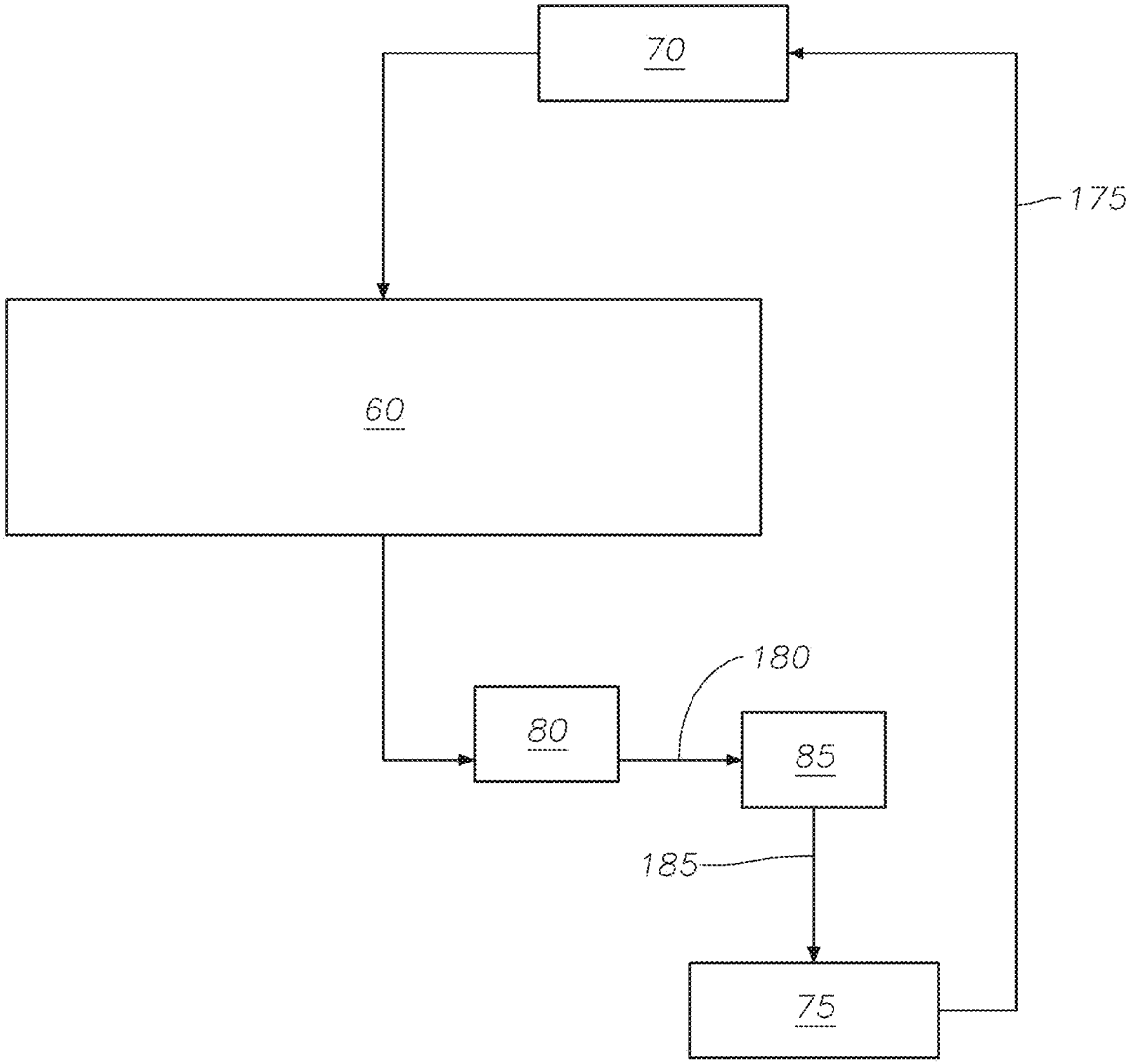
FIG. 10 provides a process diagram of an embodiment of the process.

An alternate embodiment of the de-asphalting process is described with reference to FIGS. 8-10. Referring to FIG. 8, oil feed 100 can be introduced to de-asphalting column 60 during a de-asphalting stage. De-asphalting column 60 can be operated continuously in stages, where each stage operates in continuous mode until a transition to the next stage. The stages can include a de-asphalting stage, a washing stage, and a drying stage. De-asphalting column can be a horizontal vessel or a vertical vessel. During the de-asphalting stage, de-asphalting column 60 can be operated at a reaction temperature in the range between 60 deg C. and 100 deg C. During the de-asphalting stage, de-asphalting column 60 can be operated at a reaction pressure in the range between 0 bar (0 kPa) and 100 bar (10,000 kPa). During the de-asphalting stage, de-asphalting column 60 can be operated such that the residence time is between 10 minutes and 30 minutes. De-asphalting column 60 can be filled with heteropolyacids prior to introducing oil feed 100, such that prior to the beginning of the reaction de-asphalting column 60 contains heteropolyacids. The heteropolyacids can be the same as those in charged reactor 15, but can contain binders to improve the strength of the particles of the heteropolyacids. The design of de-asphalting column 60 and the heteropolyacids can ensure that the heteropolyacids remain in the de-asphalting column 60 during the de-asphalting process, such as by sizing the heteropolyacids and including supports to retain the heteropolyacids while allowing fluids to flow through. De-asphalting column 60 is in the absence of water. De-asphalting column 60 is in the absence of paraffinic solvents. De-asphalting column 60 is in the absence of added hydrogen gas. Oil feed 100 continuously flows through de-asphalting column 60 during the de-asphalting stage. As oil feed 100 flows through de-asphalting column 60 asphaltenes in oil feed 100 can be polymerized in the presence of the heteropolyacids and the polymerized asphaltenes can precipitate out of the stream. Due to vessel design, the polymerized asphaltenes can remain inside de-asphalting column 60. Other heavier components can polymerize in de-asphalting column 60 and fall out of oil feed 100. The heteropolyacids can serve as a catalyst for an acid catalyzed polymerization reaction of the asphaltenes to produce polymerized asphaltenes. The remaining stream containing de-asphalted oil flows out of de-asphalting column 60 as de-asphalted oil 120. De-asphalting oil 120 can be further processed, such as in upgrading reactor 40. De-asphalted oil 120 is in the absence of the heteropolyacids, with the heteropolyacids remaining in de-asphalting column 60. De-asphalted oil 120 is in the absence of further processing to separate de-asphalted oil, as the stream contains only de-asphalted oil.

The de-asphalting stage can continue until the production of de-asphalted oil 120 is reduced. The de-asphalting stage can be discontinued with the flow of oil feed 100 stopped. During the washing stage, described with reference to FIG. 9, washing agent 170 from solvent tank 70 can be introduced to the top of de-asphalting column 60. De-asphalting column 60 is flushed with washing agent 170. Washing agent 170 can include a solvent capable of dissolving asphaltenes and polymerized asphaltenes to remove them from the heteropolyacids in de-asphalting column 60. The polymerized asphaltenes can surround the heteropolyacids or can be among the heteropolyacids. Examples of solvents suitable for use as washing agent 170 include toluene. During the washing stage, the pressure in de-asphalting column 60 can be in the range between 0 bar and 100 bar. During the washing stage, the temperature in de-asphalting column 60 can be in the range between 60 deg C. and 100 deg C. The pressure of washing agent 170 can be in the range between 0 bar and 100 bar. Washing agent 170 is in the absence of paraffinic solvent. The flow rate of washing agent 170 can be designed based on the size and internal volume of de-asphalting column 60. As washing agent 170 flows through de-asphalting column 60 the polymerized asphaltenes that precipitated during the de-asphalting stage can dissolve in the solvent and are washed away from the heteropolyacids. The solvent containing the dissolved polymerized asphaltenes can exit the bottom of de-asphalting column 60 as dirty solvent 160. Dirty solvent 160 can be introduced to evaporator 75. In evaporator 75, the solvent and polymerized asphaltenes are separated. Evaporator 75 can be any type of unit designed to separate a solid dissolved in a liquid. Evaporator 75 can include a unit to separate components based on a boiling point. In at least one embodiment, evaporator 75 can include a distillation column type heater. The polymerized asphaltenes separated in evaporator 75 exit as recovered asphaltenes 135. The solvent separated in evaporator 75 can exit as cleaned solvent stream 175. Cleaned solvent stream 175 can be introduced to solvent tank 70 to be used as washing agent 170 to be recycled back to the top of de-asphalting column 60. The polymerized asphaltenes can be removed from the evaporator as recovered asphaltenes 135.

The drying stage, described with reference to FIG. 10, removes all or substantially all of the residual solvent from the heteropolyacids in de-asphalting column 60. Vacuum pump 80 draws a vacuum in de-asphalting column 60. During the drying stage, the temperature in de-asphalting column 60 can be in the range between 100 deg C. and 200 deg C. The residual solvent can be removed as residual solvent stream 180 by vacuum pump 80 and is introduced to condenser 85. The residual solvent stream can be removed by the same physical line as dirty solvent 160. The residual solvent stream 180 can be condensed in condenser 85 to produce condensed solvent stream 185. Condensed solvent stream 185 can be introduced to evaporator 75. Any impurities, such as polymerized asphaltenes and the polymerized heavier components, can be removed from the residual solvent in evaporator 75. The purified residual solvent can exit evaporator 75 as cleaned solvent stream 175 and can be fed to solvent tank 70. The impurities can be disposed of or further processed.

Throughout all three stages, the heteropolyacids remain in de-asphalting column 60. The de-asphalting process described with reference to FIGS. 8-10 is in the absence of a hydrotreatment stage.

The process and system to remove asphaltenes can be positioned at a drill site to treat petroleum produced from a well or can be added to an existing refinery process upstream of an upgrading unit, such as a catalytic cracking unit, an FCC unit, a reforming unit, or a dehydrogenation process. The process and system is in the absence of added hydrogen gas

EXAMPLES

Example 1

Example 1 tested the ability of the heteropolyacids to separate asphaltenes. The heteropolyacids $H_3PW_{12}O_{40}$, $H_3PMo_{12}O_{40}$, $H_4SiW_{12}O_{40}$ and $H_4SiMo_{12}O_{40}$ were purchased from Sigma-Aldrich® (St. Louis, Mo.). The cesium substituted heteropolyacids, $Cs_xH_yPMo_{12}O_{40}$, $Cs_xH_yPW_{12}O_{40}$, $Cs_xH_ySiMo_{12}O_{40}$ and $Cs_xH_ySiW_{12}O_{40}$, in which $0<x<4$, were prepared according to the following procedure: The required amount of aqueous cesium carbonate (0.06 molar (M)) was added dropwise to an aqueous solution of a heteropolyacid (0.06 M) at 323 Kelvin (K) under agitation. The cesium substitute heteropolyacids precipitated from the solution and were recovered by filtration followed by washing with deionized water and drying by air. The recovered powder was calcined in air at 473K for two hours. All of the heteropolyacids were dehydrated at 100 deg C.

Figure 6:
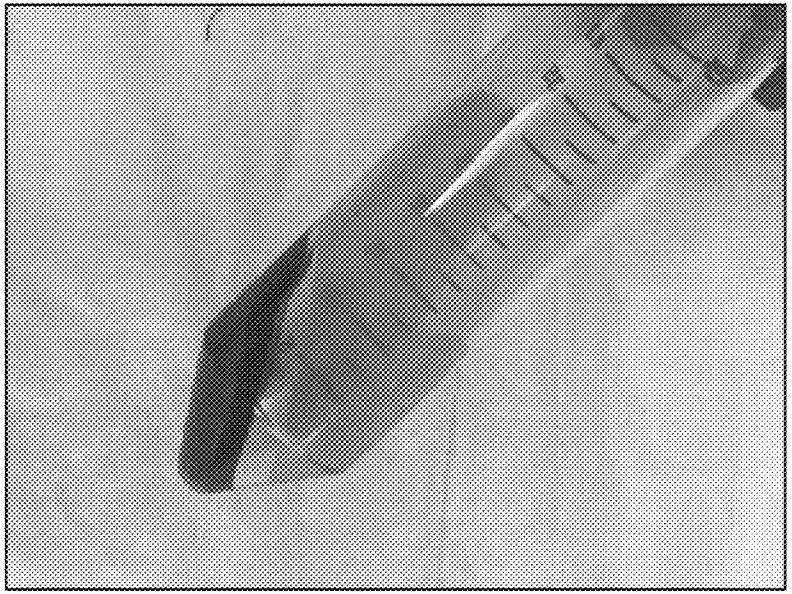
FIG. 6 is a pictorial representation of the centrifuge tube of Example 1.
Figure 7:
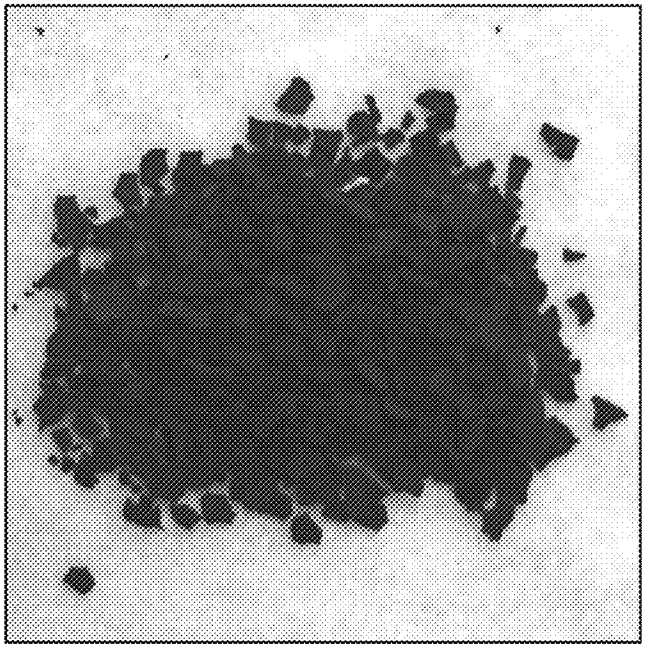
FIG. 7 is a pictorial representation of the dried recovered asphaltene of Example 1.

A benchtop process was employed, the reactor was a batch reactor with an agitator and the separator was a centrifuge. The oil feed was 5 milliliters (mL) of an Arabian light crude oil. Various properties of the oil are shown in Table 1 as determined by inductively coupled plasma mass spectrometry (ICP), x-ray fluorescence spectroscopy (XRF), and elemental CHNSO analysis. The heteropolyacids was 1 gram of $H_3PW_{12}O_{40}$. The oil and the heteropolyacids were added to the reactor at the same time. The reaction temperature in the reactor was 60 deg C. The reaction pressure in the reactor was atmospheric pressure. The reactor was under air. The reaction time was 3 hours. At the conclusion of the reaction time, the mixed product was allowed to cool and was then transferred to a centrifuge tube. The cooling time prevented the light components present in de-asphalted oil from evaporating when the reactor was opened. The centrifuge tube was placed in the separator and centrifuged at 10,000 revolutions per minute (rpm) for 20 minutes. Three layers were obtained in the centrifuge after centrifuging in the separator, see FIG. 6. The top layer contained the de-asphalted oil. The middle layer contained polymerized asphaltenes and asphaltenes. The bottom layer contained the recovered heteropolyacids. Polymerized asphaltenes and asphaltenes present in the recovered heteropolyacids were removed by washing the mixture with toluene. The asphaltene solution was then vacuum dried at room temperature and then at 100 deg C. overnight. The resulting recovered asphaltenes solids are shown in FIG. 7. The recovered heteropolyacids was vacuum dried at room temperature and then at 100 deg C. overnight. Various properties of the dried recovered asphaltenes and the de-asphalted oil are in Table 1.

TABLE 1

Properties of various streams

| Property | Arabian Light Crude Oil | Recovered asphaltenes | De-asphalted Oil | Arabian Extra Light Crude Oil |
|---|---|---|---|---|
| Hydrogen to Carbon Ratio | 1.81 to 1 | 1.22 to 1 | 1.84 to 1 | NA |
| Viscosity, cP at 25 deg C | 59.07 | N/A | 10.8 | 39.2 |
| Sulfur, % by weight | 1.83 | 3.47 | 1.06 | 1.1 |

TABLE 1-continued

| Properties of various streams | | | | |
|---|---|---|---|---|
| Property | Arabian Light Crude Oil | Recovered asphaltenes | De-asphalted Oil | Arabian Extra Light Crude Oil |
| Nitrogen, ppmw* | 1626 | 5157 | 891 | 304 |
| Nickel, ppmw | 3.90 | 51.59 | 1.26 | <1 |
| Vanadium, ppmw | 11.96 | 214.18 | 2.24 | 2 |
| Asphaltenes, % by weight | 3.5 | 100 | Less than 0.5 | NA |
| DAO yield, volume % | N/A | N/A | 83.3 | NA |

*part-per-million by weight

As shown in Table 1, the de-asphalted oil had a lower viscosity, lower sulfur concentration, lower nitrogen concentration and lower metals concentration as compared to the oil feed. The hydrogen to carbon ratio in the dried precipitated asphaltenes of 1.22 to 1 is consistent with the established hydrogen to carbon ratio values for asphaltenes. Comparing the de-asphalted oil to an Arabian extra light crude oil it can be seen that the de-asphalted oil has a lower viscosity, similar sulfur and metals content, and the nitrogen content is higher.

Example 2

Example 2 was a comparative example. The reactor and the separator were the same as used in Example 1. The oil feed was 5 mL of the same light crude oil as used in Example 1. The reactor was in the absence of heteropolyacids. The reaction conditions, reaction temperature, reaction pressure, and reaction time, were the same as in Example 1. After cooling, the reaction product was removed from the reactor and placed in a centrifuge tube and centrifuged in the separator at 10,000 rpm for 20 minutes. No asphaltene precipitation was observed after the reaction.

Example 3

Example 3 was a comparative example. The reactor and the separator were the same as used in Example 1. The feed oil was 5 mL of the same light crude oil as used in Example 1. The feed oil and 20 mL of 99% sulfuric acid were added to the reactor. The reaction conditions, reaction temperature, reaction pressure, and reaction time, were the same as in Example 1. After cooling, the reaction product was removed from the reactor and placed in a centrifuge tube and centrifuged in the separator at 10,000 rpm for 20 minutes. No asphaltene precipitation was observed after the reaction.

Comparing Example 1 to Examples 2 and 3, shows that heteropolyacids can remove asphaltenes from crude oil in the absence of paraffinic solvents, while other inorganic acids cannot.

Although described in detail, it should be understood that various changes, substitutions, and alterations can be made hereupon without departing from the principle and scope. Accordingly, the scope should be determined by the following claims and their appropriate legal equivalents. There various elements described can be used in combination with all other elements described herein unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope.

That which is claimed is:

1. A process for removing asphaltenes from an oil feed, the process comprising the steps of:

introducing the oil feed to a de-asphalting column, where the oil feed comprises a carbonaceous material and asphaltenes, where the de-asphalting column comprises a heteropolyacid;

operating the de-asphalting column at a reaction temperature and a reaction pressure for a residence time such that the heteropolyacid is operable to catalyze an acid catalyzed polymerization reaction of the asphaltenes to produce polymerized asphaltenes, where the polymerized asphaltenes precipitate from the carbonaceous material in the oil feed, where the de-asphalting column is in the absence of water; and withdrawing a de-asphalted oil from the de-asphalting column, where the de-asphalted oil is in the absence of the heteropolyacids, where the de-asphalted oil has a lower concentration of sulfur, a lower concentration of nitrogen, and a lower concentration of metals as compared to the oil feed, where the process for removing asphaltenes is in the absence of added hydrogen gas.

2. The process of claim 1, further comprising the steps of:

stopping the oil feed;

introducing a washing agent to a top of the de-asphalting column, where the washing agent flows through the de-asphalting column for a washing time, where the washing agent comprises a solvent, the solvent operable to dissolve the polymerized asphaltenes in the de-asphalting column;

removing a dirty solvent from a bottom of the de-asphalting column, where the dirty solvent comprises dissolved polymerized asphaltenes;

introducing the dirty solvent to an evaporator, where the evaporator is configured to separate the polymerized asphaltenes from the solvent;

withdrawing the solvent from the evaporator as a cleaned solvent stream; and withdrawing the polymerized asphaltenes as a recovered asphaltenes.

3. The process of claim 2, further comprising the steps of:

stopping the flow of the washing agent to the de-asphalting column;

applying a vacuum to the de-asphalting column to remove residual solvent on the heteropolyacids;

withdrawing the residual solvent from the de-asphalting column as a residual solvent stream;

introducing the residual solvent stream to a condenser;

condensing the residual solvent stream in the condenser to produce a condensed solvent stream; and introducing the condensed solvent stream to the evaporator.

4. The process of claim 1, where the carbonaceous material is selected from the group consisting of crude oil, heavy crude oil, light crude oil, vacuum residue streams, and atmospheric distillation streams.

5. The process of claim 1, where the concentration of asphaltenes in the oil feed is between 1% by weight and 20% by weight.

6. The process of claim 1, where the heteropolyacid is selected from the group consisting of Keggin-type heteropolyacids, cesium substituted heteropolyacids, and combinations of the same.

7. The process of claim 6, wherein the Keggin-type heteropolyacid is selected from the group consisting of phosphotungstic heteropolyacid ($H_3PW_{12}O_{40}$), phosphomolybdic heteropolyacid ($H_3PMo_{12}O_{40}$), silicotungstic heteropolyacid ($H_4SiW_{12}O_{40}$), silicomolybdic heteropolyacid ($H_4SiMo_{12}O_{40}$), and combinations of the same.

8. The process of claim 6, where the cesium substituted heteropolyacid is selected from the group consisting of $Cs_xH_yPMo_{12}O_{40}$, in which $0<x<4$ and y equals 3−x, $Cs_xH_yPW_{12}O_{40}$, in which $0<x<4$ and y equals 4−x, $Cs_xH_ySiMo_{12}O_{40}$, in which $0<x<4$ and y equals 3−x, and $Cs_xH_ySiW_{12}O_{40}$, in which $0<x<4$ and y equals 4−x.

9. The process of claim 1, where the reaction temperature is between 60 deg C. and 100 deg C.

10. The process of claim 1, where the reaction pressure is between 0 bar and 100 bar.

11. The process of claim 1, where the residence time is between 10 minutes and 30 minutes.

12. The process of claim 1, where the evaporator comprises a distillation column type heater.

13. The process of claim 1, where the de-asphalted oil contains less than 1% by weight asphaltenes.

14. The process of claim 1, further comprising the step of introducing the de-asphalted oil to an upgrading reactor to produce an upgraded product.

15. The process of claim 1, where the solvent comprises toluene.

* * * * *